US009552769B2

(12) United States Patent
Sakariya et al.

(10) Patent No.: US 9,552,769 B2
(45) Date of Patent: Jan. 24, 2017

(54) DISPLAY WITH A REDUCED REFRESH RATE

(71) Applicant: Apple Inc., Cupertino, CA (US)

(72) Inventors: Kapil V. Sakariya, Los Altos, CA (US); Tore Nauta, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 21 days.

(21) Appl. No.: 14/574,312

(22) Filed: Dec. 17, 2014

(65) Prior Publication Data

US 2016/0180767 A1 Jun. 23, 2016

(51) Int. Cl.

| | |
|---|---|
| ***G09G 3/3233*** | (2016.01) |
| ***G09G 3/3275*** | (2016.01) |
| ***G09G 3/32*** | (2016.01) |

(52) U.S. Cl.

CPC .... *G09G 3/3233* (2013.01); *G09G 2300/0842* (2013.01)

(58) Field of Classification Search

CPC ..... G09G 3/32; G09G 3/3275; G09G 3/3233; G09G 3/2074; G09G 3/2003; G09G 2330/028; G09G 2330/023; G09G 2330/021

See application file for complete search history.

(56) References Cited

U.S. PATENT DOCUMENTS

| | | | | |
|---|---|---|---|---|
| 7,119,765 | B2 | 10/2006 | Redecker et al. | |
| 7,537,947 | B2 | 5/2009 | Smith et al. | |
| 8,659,010 | B2 | 2/2014 | Song et al. | |
| 2007/0115244 | A1* | 5/2007 | Shin | G09G 3/3266 345/100 |
| 2011/0157147 | A1* | 6/2011 | Tsai | G09G 3/3233 345/213 |
| 2012/0113078 | A1* | 5/2012 | Kwon | G09G 3/3233 345/211 |
| 2013/0100173 | A1* | 4/2013 | Chaji | G09G 5/10 345/690 |
| 2014/0055476 | A1* | 2/2014 | Wang | G09G 5/003 345/547 |
| 2015/0243203 | A1* | 8/2015 | Kim | G09G 3/2092 345/212 |
| 2016/0086544 | A1* | 3/2016 | Park | G09G 3/3258 345/690 |

* cited by examiner

*Primary Examiner* — Lun-Yi Lao
*Assistant Examiner* — Ibrahim Khan
(74) *Attorney, Agent, or Firm* — Blakely, Sokoloff, Taylor & Zafman LLP

(57) ABSTRACT

In one embodiment, a display system includes a display panel having a plurality of display elements, a scan driver to control a leaky switch to select a storage capacitor of a display element of the plurality of display elements to receive a data signal, and a data driver to provide the data signal to the storage capacitor when the leaky switch is in an on state at each of an on voltage to illuminate the display element and an off voltage and to hold the on voltage at an input of the leaky switch when the leaky switch is in an off state.

21 Claims, 4 Drawing Sheets

DISPLAY WITH A REDUCED REFRESH RATE

BACKGROUND

Field

The disclosure relates generally to a display system, and, more specifically, to a display system with a reduced refresh rate.

Background Information

Displays panels are utilized in a wide range of electronic devices. Common types of flat display panels include active matrix display panels where each pixel may be driven to display a data frame. For some (e.g., portable) devices, the power consumed by a display panel may be a major portion of the total power consumption of the device, for example, from a battery.

SUMMARY

Methods, systems, and apparatuses for a reduced (e.g., low) refresh rate of a display panel are described. A reduced (e.g., low) refresh rate may reduce (e.g., lower) the total power consumption of the display panel.

In one embodiment, a display system includes a display panel having a plurality of display elements, a scan driver to control a leaky switch to select a storage capacitor of a display element of the plurality of display elements to receive a data signal, and a data driver to provide the data signal to the storage capacitor when the leaky switch is in an on state at each of an on voltage to illuminate the display element and an off voltage and to hold the on voltage at an input of the leaky switch when the leaky switch is in an off and/or on state. The off voltage may (e.g., be selected to) achieve a refresh rate less than about 50 Hertz. The data driver may connect to the input of the leaky switch and the storage capacitor may connect to an output of the leaky switch. The data driver may hold (e.g., during a hold time) (e.g., not only during a programming time) the on voltage at the input of the leaky switch when the leaky switch is in an off state and/or the storage capacitor is (e.g., initially) charged to the on voltage (e.g., after a programming time). The display system may include a compensating circuit to charge (or discharge) the storage capacitor to a compensated on voltage (e.g., different that the on voltage initially supplied by the data driver). The data driver may hold the compensated on voltage at the input of the leaky switch when the leaky switch is in the off and/or on state. The data driver may provide different on voltages to respective storage capacitors of each display element of the plurality of display elements. The data driver may provide different off voltages to respective storage capacitors of each display element of the plurality of display elements. The data driver may provide different on voltages to respective storage capacitors of different colored display elements of the plurality of display elements to balance a white state.

In another embodiment, a method includes selecting a storage capacitor of a display element of a plurality of display elements of a display panel to receive a data signal via a leaky switch, providing the data signal to the storage capacitor when the leaky switch is in an on state at each of an on voltage to illuminate the display element and an off voltage, and holding the on voltage at an input of the leaky switch when the leaky switch is in an off state. The method may include selecting the off voltage to achieve a refresh rate less than about 50 Hertz. The method may include providing a compensating circuit to charge the storage capacitor to a compensated on voltage, and wherein the holding comprises holding the compensated on voltage at the input of the leaky switch when the leaky switch is in the off state. The providing may include providing different on voltages to respective storage capacitors of each display element of the plurality of display elements. The providing may include providing different off voltages to respective storage capacitors of each display element of the plurality of display elements. The providing may include providing different on voltages to respective storage capacitors of different colored display elements of the plurality of display elements to balance a white state.

In yet another embodiment, an apparatus includes a set of one or more processors, and a set of one or more data storage devices that store instructions that, when executed by the set of processors, cause the set of one or more processors to perform the following: selecting a storage capacitor of a display element of a plurality of display elements of a display panel to receive a data signal via a leaky switch, providing the data signal to the storage capacitor when the leaky switch is in an on state at each of an on voltage to illuminate the display element and an off voltage, and holding the on voltage at an input of the leaky switch when the leaky switch is in an off state. The set of data storage devices may further store instructions that, when executed by the set of processors, cause the set of processors to perform the following: further comprising selecting the off voltage to achieve a refresh rate less than about 50 Hertz. The set of data storage devices may further store instructions that, when executed by the set of processors, cause the set of processors to perform the following: further comprising providing a compensating circuit to charge the storage capacitor to a compensated on voltage, and wherein the holding comprises holding the compensated on voltage at the input of the leaky switch when the leaky switch is in the off state. The set of data storage devices may further store instructions that, when executed by the set of processors, cause the set of processors to perform the following: wherein the providing comprises providing different on voltages to respective storage capacitors of each display element of the plurality of display elements. The set of data storage devices may further store instructions that, when executed by the set of processors, cause the set of processors to perform the following: wherein the providing comprises providing different off voltages to respective storage capacitors of each display element of the plurality of display elements. The set of data storage devices may further store instructions that, when executed by the set of processors, cause the set of processors to perform the following: wherein the providing comprises providing different on voltages to respective storage capacitors of different colored display elements of the plurality of display elements to balance a white state.

In another embodiment, a hardware apparatus may include means to control a leaky switch to select a storage capacitor of a display element of a plurality of display elements to receive a data signal, means to provide the data signal to the storage capacitor when the leaky switch is in an on state at each of an on voltage to illuminate the display element and an off voltage, and/or means to hold the on voltage at an input of the leaky switch when the leaky switch is in an off state.

In one embodiment, a display system includes a display panel having a plurality of display elements, a scan driver to control a leaky switch to select a storage capacitor of a display element of the plurality of display elements to receive a data signal, and a data driver to provide the data signal to the storage capacitor at each of an off voltage (e.g., that is at least three times a magnitude of a threshold voltage to turn on the display element) to display a black state and an on voltage to display an on state. The off voltage may (e.g., be selected to) provide at least three volts of charge leakage through the leaky switch before the display element turns on. The off voltage may (e.g., be selected to) provide at least four volts of charge leakage through the leaky switch before the display element turns on. The off voltage may be at least three volts (e.g., measured relative to the threshold voltage of the display element). The off voltage may be at least four volts (e.g., measured relative to the threshold voltage of the display element). The data driver may connect to an input of the leaky switch and the storage capacitor may connect to an output of the leaky switch. The data driver may provide the on voltage to the input of the leaky switch after the storage capacitor is charged to the off voltage. The data driver may provide the on voltage to the input of the leaky switch when the leaky switch is in an off state. The data driver may provide different on voltages to respective storage capacitors of each display element of the plurality of display elements. The data driver may provide different off voltages to respective storage capacitors of each display element of the plurality of display elements. The data driver may provide different on voltages to respective storage capacitors of different colored display elements of the plurality of display elements to balance the white state.

In another embodiment, a method includes selecting a storage capacitor of a display element of a plurality of display elements of a display panel to receive a data signal via a leaky switch, and providing the data signal to the storage capacitor at each of an off voltage that is at least three times a magnitude of a threshold voltage to turn on the display element to display a black state and an on voltage to display a white state. Providing may include providing the on voltage to an input of the leaky switch after the storage capacitor is charged to the off voltage. Providing may include providing the on voltage to an input of the leaky switch when the leaky switch is in an off state. Providing may include providing different on voltages to respective storage capacitors of each display element of the plurality of display elements. Providing may include providing different off voltages to respective storage capacitors of each display element of the plurality of display elements. Providing may include providing different on voltages to respective storage capacitors of different colored display elements of the plurality of display elements to balance the white state.

In yet another embodiment, an apparatus includes a set of one or more processors, and a set of one or more data storage devices that store instructions that, when executed by the set of processors, cause the set of one or more processors to perform the following: selecting a storage capacitor of a display element of a plurality of display elements of a display panel to receive a data signal via a leaky switch, and providing the data signal to the storage capacitor at each of an off voltage that is at least three times a magnitude of a threshold voltage to turn on the display element to display a black state and an on voltage to display a white state. The set of data storage devices may further store instructions that, when executed by the set of processors, cause the set of processors to perform the following: wherein the providing comprises providing the on voltage to an input of the leaky switch after the storage capacitor is charged to the off voltage. The set of data storage devices may further store instructions that, when executed by the set of processors, cause the set of processors to perform the following: wherein the providing comprises providing the on voltage to an input of the leaky switch when the leaky switch is in an off state. The set of data storage devices may further store instructions that, when executed by the set of processors, cause the set of processors to perform the following: wherein the providing comprises providing different on voltages to respective storage capacitors of each display element of the plurality of display elements. The set of data storage devices may further store instructions that, when executed by the set of processors, cause the set of processors to perform the following: wherein the providing comprises providing different off voltages to respective storage capacitors of each display element of the plurality of display elements. The set of data storage devices may further store instructions that, when executed by the set of processors, cause the set of processors to perform the following: wherein the providing comprises providing different on voltages to respective storage capacitors of different colored display elements of the plurality of display elements to balance the white state.

In another embodiment, a hardware apparatus may include means to control a leaky switch to select a storage capacitor of a display element of a plurality of display elements to receive a data signal, and/or means to provide the data signal to the storage capacitor at each of an off voltage that is at least three or four times a magnitude of a threshold voltage to turn on the display element to display a black state and an on voltage to display a white state.

BRIEF DESCRIPTION OF THE DRAWINGS

Embodiments are illustrated by way of example and not limitation in the Figures of the accompanying drawings.

DETAILED DESCRIPTION

Figure 2:
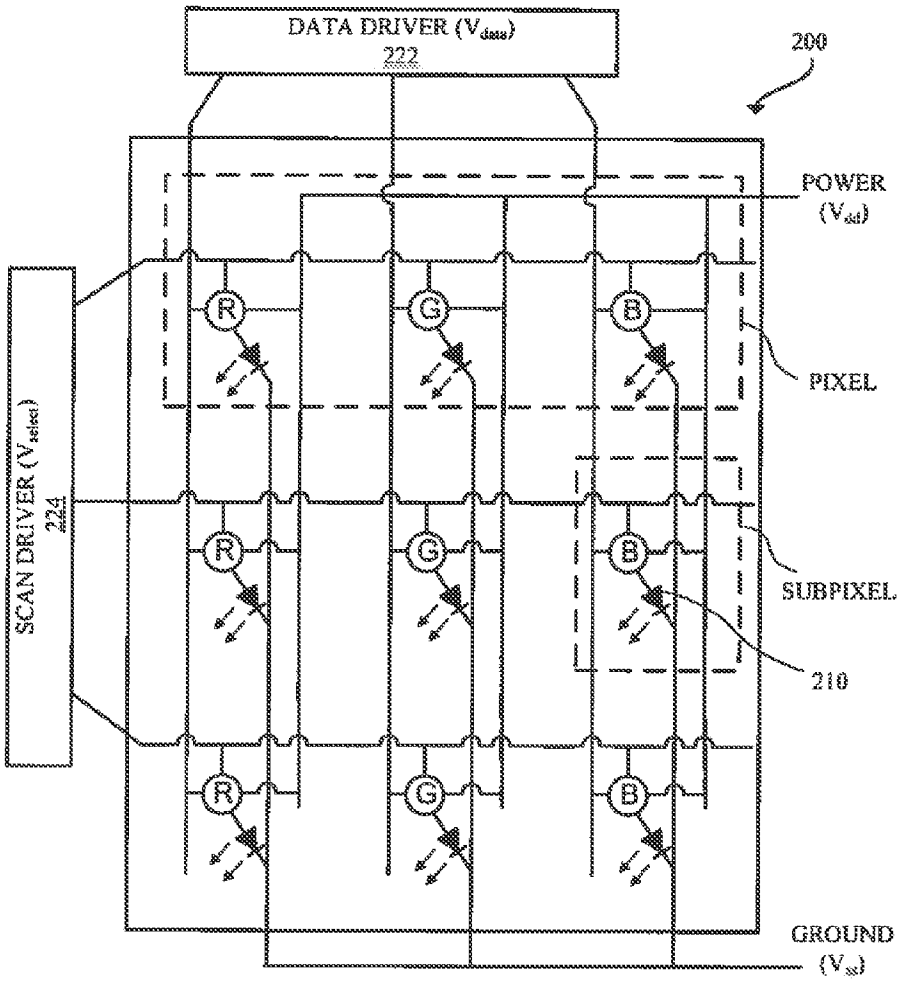
FIG. 2 is a circuit diagram of an active matrix display system according to one embodiment.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. In other instances, well-known techniques and components have not been described in particular detail in order to not unnecessarily obscure the present disclosure. Reference throughout this specification to "one embodiment," "an embodiment", or the like means that a particular feature, structure, configuration, or characteristic described in connection with the embodiment is included in at least one embodiment of the disclosure. Thus, the appearances of the phrase "in one embodiment," "in an embodiment", or the like in various places throughout this specification are not necessarily referring to the same embodiment of the disclosure. Furthermore, the particular features, structures, configurations, or characteristics may be combined in any suitable manner in one or more embodiments.

High-resolution color display panels, such as computer displays, smart phones, and televisions, may use an active matrix display structure. An active matrix display of m×n display (e.g., pixel) elements may be addressed with m row lines and n column lines or a subset thereof. A set of switches (for example, transistors) and storage capacitors may be connected to each display (e.g., pixel) element, for example, allowing each column line to access one storage capacitor of a display element (e.g., light emitting diode (LED) or other light emitting material).

A display system (e.g., circuit) may include a leaky switch, e.g., as part of a display driver hardware circuit. A switch may leak charge, for example, over a period of time between the storage capacitor being charged to a desired voltage and the next refresh, e.g., a hold time. A switch may leak charge to cause a display element to not be in the programmed state (e.g., off state or on state), for example, over a period referred to as a frame time in seconds (the inverse is generally referred to as the refresh rate which may be measured in Hertz (Hz) or frames per second). The frame time may generally refer to the time it takes to execute a single frame. The frame time may include a programming time and a hold time. A leaky switch may be a transistor, for example, a metal-oxide semiconductor field-effect transistor (MOSFET) or a thin film transistor (TFT), such as, but not limited to, a low temperature polycrystalline silicon thin film transistor (LTPS-TFT). A leaky switch may be a pixel switch. A leaky switch connected to a storage capacitor may leak charge (e.g., discharge) via a leakage current (e.g., an off state current of a transistor). A leakage current may refer to a current flowing between the drain and the source electrodes of a transistor (e.g., MOSFET), for example, when the transistor is in the off state. A display system may include a leaky switch (e.g., a leaky transistor) that leak charges (e.g., via a leakage path) from an attached storage capacitor at a discharge rate that exceeds the refresh rate of the display panel, for example, such that the display system may not achieve that refresh rate. A display system (e.g., a leaky switch thereof) may include other parasitic leaks.

A leaky switch may be operated to select (e.g., selectively connect) a storage capacitor of a display element (e.g., of the plurality of display elements) to receive a data signal (e.g., a signal to turn a display element off or on). Apparatuses (e.g., a circuit and/or logic) and methods disclosed herein may include providing a data signal to a storage capacitor (e.g., connected to a display element) when a leaky switch is in an on state (e.g., forming a conducting path) at each of an on voltage to illuminate the display element and an off voltage, for example, where the display element is not emitting (e.g., visible to the human eye) light. Apparatuses (e.g., a circuit and/or logic) and methods disclosed herein may include holding that on voltage at an input of the leaky switch when the leaky switch is in an off state. A leaky switch may be connected between a storage capacitor and a data driver (e.g., an output voltage driver) to allow that data driver to charge the storage capacitor to a desired voltage (e.g., when the switch is in an on state that electrically connects the storage capacitor and the data driver, which may be referred to as the programming time).

In certain embodiments, a storage capacitor may be charged to an on voltage (e.g., such that the display element associated with the storage capacitor is in an emissive state). Apparatuses (e.g., a circuit and/or logic) and methods disclosed herein may include providing (e.g., holding) the on voltage at an input of the leaky switch when the leaky switch is in an off state, for example, such that opposing portions of the leaky switch (e.g., the leakage path) may be at the same (or about the same) voltage. In certain embodiments, this may be generally referred to as a non-leaking on state such that the display element may remain on (e.g., emitting light), for example, such that the charge in the storage capacitor does not leak out through the leaky switch. Additionally or alternatively, apparatuses (e.g., a circuit and/or logic) and methods disclosed herein may include selecting (e.g., providing) an off voltage to achieve a desired refresh rate.

A refresh rate may be a reduced (e.g., relative to a 50 Hz, 60 Hz, 100 Hz, 120 Hz, 200 Hz, or 240 Hz) refresh rate. A reduced refresh rate may be less than about 0.5, 1, 2, 3, 4, 5, 6, 7, 8, 9, 10, or 20 Hz. A reduced (e.g., low) refresh rate may be less than about 50 or 60 Hz.

In certain embodiments, when a display element is selected to receive a data signal, a storage device (e.g., capacitor) connected to the display element may receive the data signal, for example, receive a voltage corresponding to the picture information (e.g., data frame). A (e.g., leaky) switch may selectively connect a storage capacitor to a power (e.g., voltage) supply. A data driver may be hardware, e.g., data driver logic. A data driver may include a power supply (e.g., an output voltage driver) to provide a data signal to a storage capacitor. A storage capacitor may receive a data signal (e.g., an applied voltage) as a (e.g., discrete) pulse, for example, such that the data signal (e.g., an off voltage or an on voltage) is not supplied to the storage capacitor after the storage capacitor is charged to a desired level (e.g., to the off voltage or the on voltage). In one embodiment, a data driver may supply the data signal to the storage capacitor, e.g., via a leaky switch. In one embodiment, a data driver may supply either of an off voltage and an on voltage, e.g., an off voltage where a connected display element is in the off (e.g., non-emissive) state and an on voltage where the connected display element is in the on (e.g., emissive) state. In one embodiment, a scan driver may control (for example, into an off (e.g., disconnected) state or an on (e.g., connected) state) a leaky switch. A scan driver may be hardware, e.g., scan driver logic. A scan driver may control a leaky switch to select a storage capacitor of a display element of a plurality of display elements to receive a data signal (e.g., a voltage, such as, but not limited to, an off voltage or an on voltage). A data driver may provide the data signal to the storage capacitor at each of an off voltage (e.g., selected) to turn off the display element to display a black state and an on voltage (e.g., selected) to turn on the display element to display an on (e.g., emitting light) state. In one embodiment, a black state is a non-emissive state for a display element (e.g., an LED) and an on state is an emissive state for a display element (e.g., an LED). A display element may be a micro LED, where the term micro in micro LED may refer to a width and/or length less than or equal to about 1 to 100 μm.

In one embodiment, a scan driver and/or data driver may allow a specific display element (e.g., LED) to receive a data signal, for example, a storage capacitor connected to the display element to receive the data signal. In one embodiment, a scan driver and/or data driver may allow a subset of display elements (e.g., LEDs) to receive a data signal, for example, a subset of less than all of the display elements of a display panel. For example, a subset of display elements may be connected to a single storage capacitor or may each have their own storage capacitor connected thereto.

In one embodiment, a display system (e.g., circuit) may include a hardware data driver that outputs either an on voltage or an off voltage. For example, a hardware data driver that defaults to supplying a leaky switch connected between a power supply (e.g., an output voltage driver, such as, but not limited to a digital to analog converter (DAC)) and a storage capacitor (e.g., connected to the display element) an on voltage and that may supply (e.g., pulse) an off voltage to the storage capacitor via the leaky switch (e.g., MOSFET). For example, a power supply (e.g., an output voltage driver) may only output an off voltage or an on voltage. In one embodiment, a drain or source electrode of a MOSFET may connect to a power supply (e.g., via data driver) and the other of the drain or source electrode may connect to a storage capacitor, for example, to allow the selective charging of the storage capacitor via control of the gate terminal (e.g., via a scan driver). In an embodiment, a data driver may supply a single level of an off voltage and a single level of an on voltage. In another embodiment, a data driver may supply various levels of off voltage(s) and/or on voltage(s), e.g., to each display element.

In one embodiment, a leaky switch may discharge the connected storage capacitor, e.g., that is connected to the display element. For example, a storage capacitor may be connected, e.g., via a second switch, to a display element such that the storage capacitor is the power source for the display element. A storage capacitor may receive a data signal, for example, the storage capacitor may receive (e.g., be charged to) either an on voltage or an off voltage. A threshold voltage (Vt) may refer to a voltage level to be reached to turn on a display element. The threshold voltage may be a threshold voltage of a transistor (e.g., a MOSFET) and/or a diode (e.g., LED) utilized in the circuit. In one embodiment, a threshold voltage may refer to the voltage (e.g., at a point in the circuit) to turn a display element from an off (e.g., non-emissive) state to an on (e.g., emissive) state. In one embodiment, a threshold voltage may refer to the minimum gate to source voltage differential that creates a conducting path between the source and drain electrodes. A leaky switch may connect between the storage capacitor and the power supply (e.g., an output voltage driver) for charging the storage capacitor. In one embodiment, a storage capacitor may be charged (e.g., initially in each refresh which may be referred to as a programming time) to an off voltage (e.g., measured relative to the threshold voltage to turn on the connected display element) with a magnitude that allows (e.g., ensures) a desired refresh rate, e.g., a reduced refresh rate. For example, a data driver may output an off voltage to (e.g., across) the storage capacitor to allows for a desired refresh rate, e.g., a reduced refresh rate.

Figure 1:
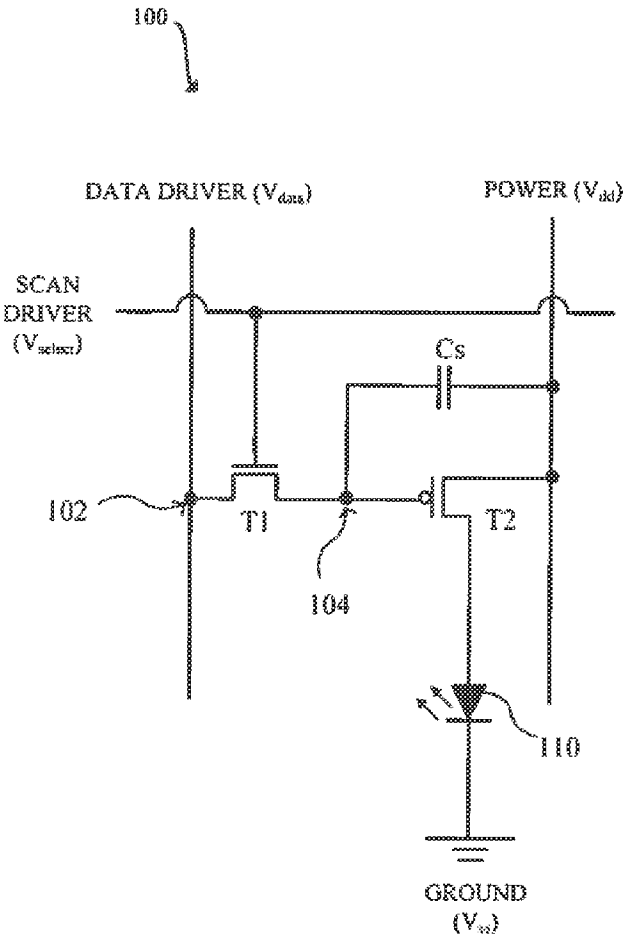
FIG. 1 is a circuit diagram of a pixel in a display system according to one embodiment.

In one embodiment, a storage capacitor may be charged (e.g., initially in each refresh which may be referred to as a programming time) to an off voltage (e.g., measured relative to the threshold voltage to turn on the connected display element) with a magnitude that is at least (e.g., about) 3.0, 3.5, 4.0, 4.5, 5.0, 5.5, 6.0, 6.5, 7.0, 7.5, 8.0, or 8.5 times a magnitude of the threshold voltage to turn on a display element connected to (e.g., driven by) the storage capacitor FIG. 1 is a circuit 100 diagram of a pixel (e.g., subpixel) in a display system according to one embodiment. Although a single circuit is shown, multiple such circuits may be used. Circuit 100 may generally be referred to as a two transistor (T1, T2) and one storage capacitor (Cs) circuit. Depicted circuit 100 includes a switch transistor T1, a drive transistor T2, a storage capacitor Cs, and an (e.g., micro) LED device 110. A transistor (T1, T2) may be any type of transistor. For example, the switch transistor T1 may be an n-type metal-oxide semiconductor (NMOS) transistor, and the drive transistor T2 may be a p-type metal-oxide semiconductor (PMOS) transistor. Depicted switch transistor T1 includes a gate electrode connected to a scan line ($V_{select}$) and a first source or drain electrode connected to a data line ($V_{data}$). Depicted drive transistor T2 includes a gate electrode connected to the other of the source or drain electrode of the switching transistor T1 and a first source or drain electrode connected to a power supply ($V_{dd}$). Depicted storage capacitor Cs is connected between the gate electrode of the drive transistor T2 and the first source or drain electrode of the drive transistor T2. Alternatively, instead of connecting to the first source or drain electrode of T2, storage capacitor Cs may be connected to its own ground line, the anode electrode of the LED 110, a previous or next row of the scan line, or other alternative locations in the circuitry. Depicted (e.g., micro) LED device 110 has an anode electrode connected to a second source or drain electrode of the drive transistor T2 and a cathode electrode connected to a ground ($V_{ss}$). Alternatively, the (e.g., micro) LED 110 may have the cathode electrode connected to the second source or drain electrode of T2 and the anode electrode connected to $V_{dd}$, where $V_{dd}$ in FIG. 1 may be replaced by $V_{ss}$ in this alternative embodiment. It is to be appreciated that the embodiment of FIG. 1 is exemplary and alternative embodiments may exist.

Figure 5:
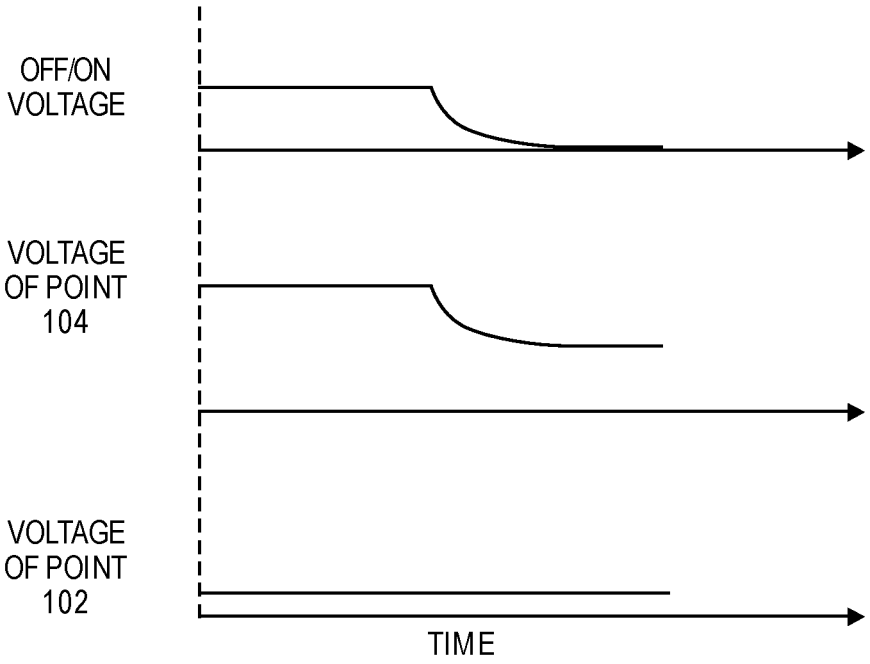
FIG. 5 is a timing diagram for off/on voltage, voltage at point 102, and voltage at point 104 of FIG. 1 in accordance with one embodiment.

The data signal to charge the storage capacitor Cs. The voltage potential that stores within the storage capacitor Cs may determine the magnitude of the current flowing through the driving transistor T2, so that the (e.g., micro) LED 110 may emit light based on the current. The data signal (e.g., from a data driver) may be at an off voltage or an on voltage for the display element (e.g., depicted as LED 110). As switch T1 (e.g., drive transistor) may be a leaky switch, for example, leaking current from storage capacitor Cs to the data driver portion of the circuit 100. Switch (e.g., T1) may leak when there is a voltage differential across its source and drain (e.g., points 102 and 104). Circuitry and/or methods herein may include defaulting the circuit such that a terminal (e.g., an input and/or an output) of a leaky switch (e.g., at point 102), for example, the source or drain of a MOSFET, receives an on voltage (e.g., 1V) unless the storage capacitor (Cs) is to be charged to an off voltage (e.g., 3, 4, 5, 6, 7, 8, 9, 10, 20, 30, 40, 50, 60, 70, 80, 90, or 100V) of a magnitude (e.g., an absolute value) to allow for a reduced (e.g., low) refresh rate (e.g., 1 Hz). For example, the storage capacitor may be charged from point 104 (e.g., the other of the source or drain of a MOSFET) through switch T1 with a voltage to provide the desired off voltage to the storage capacitor. In one embodiment, the term off voltage generally refers to the net voltage across the storage capacitor (Cs). In one embodiment, a data driver includes (e.g., outputting) an off voltage to the storage capacitor selected to allow for at least 3 or 4 volts (e.g., 3-4V) of decay as illustrated in FIG. 5 before the LED turns on (e.g., reaches the threshold voltage).

As one example in reference to FIG. 1, the power (Vdd) may be (e.g., constant) 5V and the threshold voltage (Vt) of the switch T2 may be 1V (e.g., 1V±15%). In such an example, the voltage supplied to (e.g., across) the storage capacitor may be 3V, e.g., 5V supplied at one electrode of the storage capacitor Cs and 8V supplied at the other electrode (e.g., at point 104). If switch T2 is a PMOS transistor, T2 may be in an off state when Vgs (the voltage between the gate and the source) is greater than the negative threshold voltage (Vt) of T2 (i.e., $Vgs > -Vt_{(T2)}$) and no current may flow to illuminate display element (e.g., LED) 110. Vgs (e.g., the voltage across the storage capacitor Cs) in this example is 3V so the difference between Vgs (3V) and $-Vt_{(T2)}(-1V)$ is 4V of off voltage relative to the $Vt_{(T2)}$ to turn on the display element. Thus the off voltage (e.g., relative to the threshold voltage $Vt_{(T2)}$ to turn on the display element 110) in this example is 4V and the magnitude of the threshold voltage $Vt_{(T2)}$ to turn on the display element is 1

(i.e., the absolute value of $Vt_{(T2)}$) such that the off voltage is 4 times the magnitude of the threshold voltage to turn on the display element. In another example, the off voltage (e.g., the off voltage differential between the threshold voltage and the off voltage value) is 3V and the magnitude of the threshold voltage to turn on the display element is 1 (e.g., the absolute value of Vt) such that the off voltage is 3 times the magnitude of the threshold voltage to turn on the display element. In yet another example, the off voltage (e.g., the off voltage differential between the threshold voltage and the off voltage value) is 6V and the magnitude of the threshold voltage to turn on the display element is 1 (e.g., the absolute value of Vt) such that the off voltage is 6 times the magnitude of the threshold voltage to turn on the display element.

In one aspect, a micro LED display element may be utilized such that the power consumed by the micro LED is a minor portion of the total power consumption of the display device, for example, from a battery. In such an aspect, micro LEDs may be highly efficient at light emission and consume significantly (e.g., orders of magnitude) less power (e.g., 250 mW) at emission compared to other display elements (for example, LEDs or OLEDs, e.g., with 5-10 watts of power consumption for OLED emission). Assuming that the power consumption required for refreshing the display data remains the same (e.g., 1 watt), the percentage of power required for a refresh cycle relative to the total power consumption for a micro LED display panel is more significant. Aspects of this disclosure may provide for reducing the refresh power consumption by reducing the refresh rate of the display panel, e.g., without degrading the image quality beyond a predetermined design limit.

In one embodiment, an off (e.g., black) state (e.g., of data driver) includes point 102 (e.g., an input of a switch) being held at (e.g., defaulting to) the on voltage (e.g., 1V), for example, as supplied from the data driver, and point 104 (e.g., an output of the switch) is initially at a voltage (e.g., 8-10V) corresponding to the off voltage of the storage capacitor Cs (e.g., 4-6V for a PMOS T2 where $-Vt_{(T2)}$ is −1 and Vdd is 5V). In such an embodiment, the off voltage may be selected to produce a desired (e.g., reduced) refresh rate that accommodates the leakage of charge from storage capacitor Cs. For example, an off voltage selected (e.g., initially) for storage capacitor Cs to retain point 104 from transitioning to a voltage (e.g., magnitude) that turns the display element (e.g., LED) on (e.g., reaching T2's and/or the LED's threshold voltage) until the refresh operation occurs (e.g., the charging of the Cs to an off voltage or an on voltage for the display element 110). In one embodiment, the off voltage may be selected to (e.g., initially) charge storage capacitor Cs to retain point 104 (e.g., the source or drain of a MOSFET) from transitioning to a voltage (e.g., magnitude) that turns the display element (e.g., LED) on (e.g., reaching T2's and/or the LED's threshold voltage) until the refresh operation is completed or is initiated (for example, the storage capacitor Cs has begun recharging, e.g., the Cs' voltage moving toward the off voltage for a black (off) state refresh). An off voltage or an on voltage may refer to the voltage value at (e.g., across) the storage capacitor to turn a connected display element off or on, respectively.

In one embodiment, an on (e.g., white) state (e.g., of data driver) includes having point 102 (e.g., the source or drain of a MOSFET) and point 104 (e.g., the other of the source or drain of a MOSFET) be at the same voltage (e.g., about 1V), for example, by supplying an on voltage to one terminal of a leaky switch (for example, source or drain of T1, e.g., point 102) with the storage capacitor (e.g., Cs) connected to another terminal of the switch (for example, the other of the source or drain of T1, e.g., point 104) also charged to (e.g., at least initially) the on voltage. In one embodiment, the on (e.g., emitting white or a primary color) state may not leak (for example, not decay over any period of time, e.g., during a refresh cycle). In one embodiment, the data driver may hold (e.g., provide during a hold time and not necessarily during a programming time) an on voltage to an input (e.g., the source or the drain of a MOSFET) of a leaky switch (e.g., T1) except when an off voltage is pulsed, for example, an off voltage supplied for a time period less than the time period that the on voltage is supplied.

In one embodiment, the on voltage of the storage capacitor is held (e.g., provided during the hold time) at the leakage path (e.g., leaky switch) to restrict discharge of the storage capacitor by the leaky switch when the storage capacitor is charged to the on voltage.

The term "on" in connection with a device may generally refer to an activated state of the device, and the term "off" used in this connection may refers to a deactivated state of the device. The term "on" used in connection with a signal received by a device may generally refer to a signal that activates the device, and the term "off" used in this connection may generally refer to a signal that deactivates the device. A device may be activated by a high voltage or a low voltage, depending on the underlying principles implementing the device. For example, a PMOS may be activated by reaching (e.g., applying) a low voltage while a NMOS transistor may be activated by reaching (e.g., applying) a high voltage. Thus, it should be understood that an on voltage for a PMOS transistor and an on voltage for a NMOS transistor device may correspond to opposite (e.g., low vs. high) voltage levels. In certain embodiments, the off voltage and/or on voltage levels may be selected (e.g., for or by the data driver) for a particular display element (e.g., LED). In one embodiment, different colors of display elements (e.g., red, green, or blue LEDs) have different threshold voltages such that a data driver outputs a different on voltage and/or off voltage to each color display element. Circuitry and/or methods herein may include providing a different on voltage and/or off voltage to each color display element of a multiple color display panel, e.g., to create a balanced white state.

It is to be appreciated that this circuitry is meant to be exemplary, and that other types of circuitry or modifications of display circuitry are contemplated in accordance with embodiments of the disclosure. For example, more complicated circuits may be used to compensate for variations in the electrical properties of the drive transistor and the (e.g., micro) LED and/or for any instabilities. One non-limiting example is a six transistor and one capacitor circuit (6T1C). Circuits may include a compensating (e.g., pixel) circuit and/or other circuit including a transistor for brightness control. Compensation circuit may charge (e.g., modify the voltage at the storage capacitor as sent from the data driver) the storage capacitor to a compensated on voltage, for example, to compensate for the different threshold voltage of the components (e.g., transistors, diodes, etc.) of the display circuitry. In one embodiment, data driver may hold the compensated on voltage at the leakage path (e.g., at the input of the leaky switch when the leaky switch is in the off state). For example, a data driver may supply an on voltage of 5V to a storage capacitor of a display element to illuminate the associated display element and a compensating circuit may determine that the 5V on voltage is not sufficient to turn the display element on and/or to have a uniform brightness of each display element and thus apply a compensated on voltage of 6V (e.g., adding 1V to the 5V) to the storage capacitor. Apparatuses and methods herein may include holding the compensated on voltage (e.g., 6V in the above, non-limiting example) instead of the original on voltage (e.g., 5V in the above, non-limiting example) at the input of the leaky switch when the leaky switch is in the off state, e.g., to eliminate the leakage of charge from the storage capacitor caused by the leaky switch.

Circuitry and/or methods herein may include setting the on voltage and/or off voltage using the leakage rate of the storage capacitor to achieve a reduced (e.g., low) refresh rate. In one embodiment, a hold voltage ($V_{hold}$) may be an on voltage (e.g., for a display element). In one embodiment, an on voltage (e.g., for a display element) as measured at a storage capacitor may be held (e.g., during a hold time) at a leakage path (e.g., of a leaky switch) so as to balance the voltage on each side of the leak such that the leakage path does not leak in such a state (e.g., when the leaky switch is in an off state). An on voltage (e.g., a compensated on voltage) and/or an off voltage may be estimated by an algorithm in a hardware processor or determined during a calibration (e.g., during manufacturing).

FIG. 2 is a circuit diagram of an active matrix display system 200 according to one embodiment. The active matrix display system 200 is one example of a display panel and includes a subpixel circuit, which may be circuit 100 from FIG. 1. As illustrated, the scan lines $V_{select}$ are oriented horizontally and a driven by one or more scan drivers 224, and the data lines $V_{data}$ are oriented vertically and are driven by one or more data drivers 222, e.g., as disclosed herein. In one embodiment, red (R), green (G), and blue (B) light emitting (e.g., micro) devices 210 are placed between the scan lines and data lines. It is to be appreciated that in alternative embodiments, the (e.g., micro) LED devices 210 may be an OLED device, and the active matrix display 200 may be based on light emission devices such as LED or OLED devices.

In one embodiment, a row line is selected by scan driver 224 and all of the storage capacitors (not shown) connected to display (e.g., pixel) element(s) in that row may be charged by the data driver 222 such that a voltage(s) corresponding to the picture information (e.g., data frame) may be driven onto the storage capacitors for each column in that row. That row line may then be deactivated and the next row line may be selected. All of the row lines may be selected (e.g., in sequence from top to bottom) during a refresh operation. This refresh operation may be repeated multiple times per second. Although a scan driver is shown as connecting horizontal rows, additionally or alternatively, it may connect to a vertical column. In one embodiment, a scan driver may allow a data driver to connect to each display element (e.g., LED 210), for example, to allow a data driver to supply a voltage (e.g., an off or an on voltage) to each display element's storage capacitor. For example, a data driver may supply a different off voltage to different storage capacitors for display elements (e.g., LEDs). For example, a data driver may supply a different on voltage to storage capacitors for display elements (e.g., LEDs).

Figure 3:
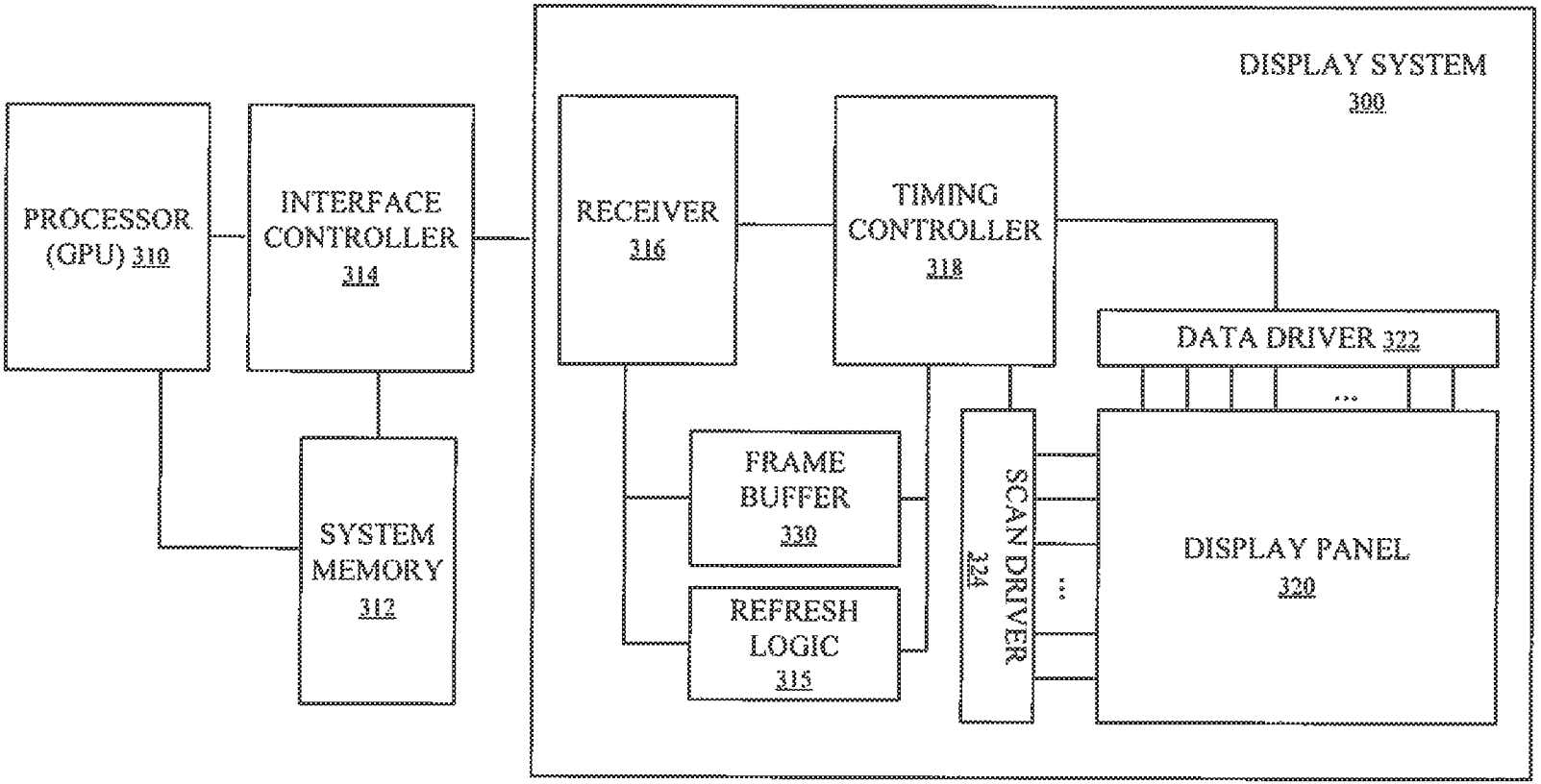
FIG. 3 is a display system according to one embodiment.

FIG. 3 illustrates a display system 300 in accordance with an embodiment of the disclosure. Depicted display system 300 includes a display panel 320 driven by display driver hardware circuitry, which includes a data driver 322 and a scan driver 324. The scan driver 324 may select a row of the display panel 320 at a time by providing an on voltage to the selected row. The selected row may be activated to receive (e.g., display) data signal (e.g., on voltage or an off voltage for each display element) from the data driver 322.

Depicted display panel 320 is an active matrix display that includes a two-dimensional matrix of display elements. In certain embodiments, the display panel 320 may include multiple stacked layers of two-dimensional matrix of display elements. In one embodiment, each display element is an emissive device, which, for example, may include LEDs, OLEDs, micro LEDs, liquid crystal displays (LCDs) (e.g., with switching polarity), interferometric modulator (IMOD) display element, or other light-emissive elements, e.g., those connected to an analog storage device (e.g., a storage capacitor).

Display panel 320 may include a matrix of pixels. Each pixel may include multiple subpixels that emit different colors of lights. In a red-green-blue (RGB) subpixel arrangement, each pixel may include three subpixels that emit red light, green light, and blue light, respectively. It is to be appreciated that the RGB arrangement is exemplary and that this disclosure is not so limited. Examples of other subpixel arrangements that can be utilized include, but are not limited to, red-green-blue-yellow (RGBY), red-green-blue-yellow-cyan (RGBYC), or red-green-blue-white (RGBW), or other subpixel matrix schemes where the pixels may have different number of subpixels, such as those manufactured under the trademark name PenTile®.

In one embodiment, the data driver 322 and the scan driver 324 may be controlled by a timing controller 318. The timing controller 318 may provide the scan driver 324 a select signal indicating which row is to be selected next for refresh. The timing controller 318 may present a data line to the data driver 322 in the form of a row of voltages, e.g., for the storage capacitors. Each data signal (e.g., voltage) may charge a storage capacitor of a corresponding subpixel in the selected row so as to emit a colored light at a specified intensity level from the display element connected to a storage capacitor. Rows may be refreshed sequentially. Alternatively, rows may be addressed directly and refreshed one at a time in any given order. In yet another embodiment, the rows may be partitioned into several non-overlapping (or overlapping) row segments. Each row segment can be addressed directly and the rows within a segment can be refreshed sequentially or in any given order. The illustrated embodiment shows that the timing controller 318, the data driver 322, and the scan driver 324 as separate components. In an alternative embodiment, the timing controller 318 and the data driver 322 may be one single (e.g., unitary) hardware component. In yet another embodiment, the timing controller 318, the data driver 322, and the scan driver 324 may be one single (e.g., unitary) hardware component.

Depicted display system 300 includes a receiver 316 to receive display data from outside of the display system 300. The receiver 316 may be configured to receive data wirelessly, by a wire connection, by an optical interconnect, or any other connection.

The receiver 316 may receive display data from a processor 310 via an interface controller 314. In one embodiment, the processor 310 may be a graphics processing unit (GPU), a general-purpose processor having a GPU located therein, and/or a general-purpose processor with graphics processing capabilities. The interface controller 314 may provide display data and synchronization signals to the receiver 316, which in turn may provide the display data to the timing controller 318. The display data may be generated in real time by the processor 310 executing one or more instructions in a software program, or retrieved from a system memory 312.

Depending on its applications, the display system 300 may include other components. These other components include, but are not limited to, memory, a touch-screen controller, and a battery. In various implementations, the display system 300 may be a television, tablet, phone, laptop, computer monitor, automotive heads-up display, automotive navigation display, kiosk, digital camera, hand-held game console, media display, ebook display, or large area signage display.

According to one embodiment of the disclosure, the display system 300 may include refresh logic 315 and a frame buffer 330. The refresh logic 315 may determine which rows are to be refreshed and which rows are to be skipped, e.g., refreshing based on exceeding a threshold content change in successive data frames.

In the illustrated embodiment, the refresh logic 315 and the frame buffer 330 are located in the display system 300 and are couple to the timing controller 318. In an alternative embodiment, the refresh logic 315 and the frame buffer 330 may be located within the timing controller 318, the receiver 316, the interface controller 314, the processor 310, or another component within or coupled to the display system 300. The refresh logic 315, data driver 322, and/or scan driver 324 may be implemented by hardware circuitry (such as integrated circuitry). The frame buffer 330 may be a memory device, such as a dynamic random access memory (DRAM), or other types of volatile or non-volatile random access memory devices.

The refresh logic 315 may determine which rows to refresh and when to refresh the rows. In one embodiment, the refresh logic 315 compares a data line of a current data frame with the corresponding data line of a previous data frame to determine whether or not this data line is to be refreshed. The data lines used for the comparison may be stored in the frame buffer 330. A number of alternative approaches for performing the comparison may be utilized.

Figure 4:
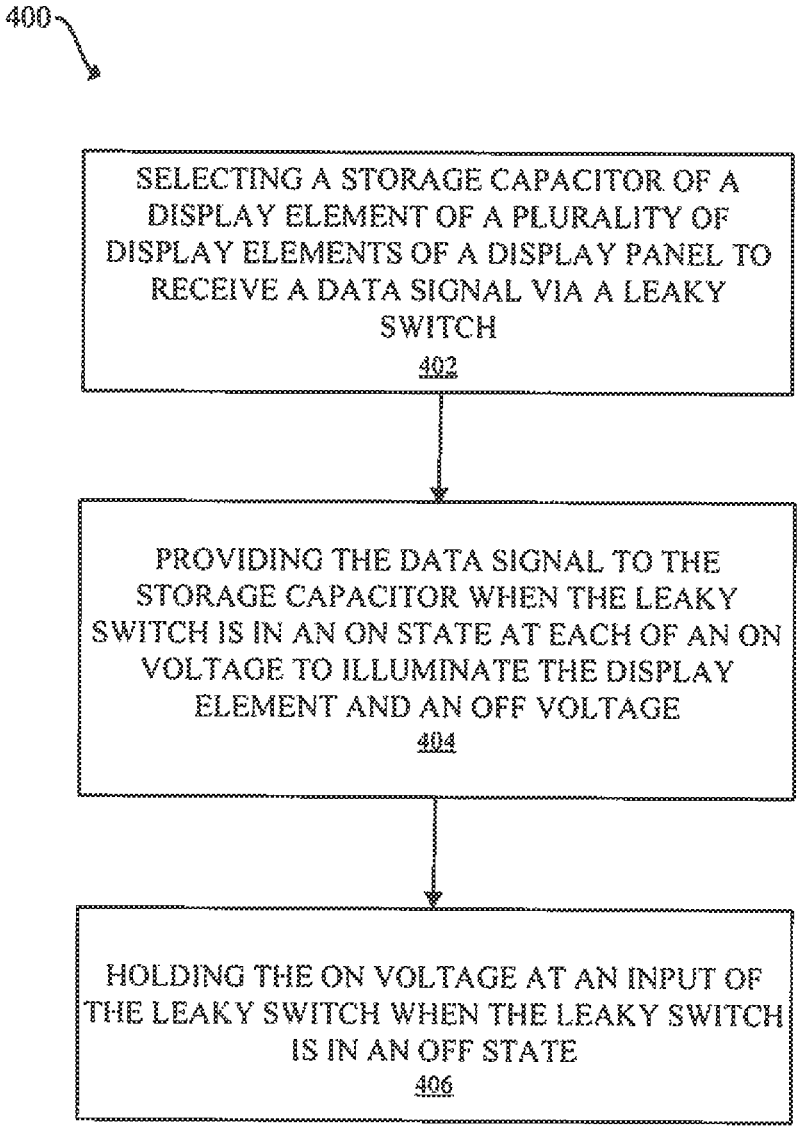
FIG. 4 is a flow diagram according to one embodiment.

FIG. 4 is a flow diagram 400 according to one embodiment. Depicted flow diagram 400 includes selecting a storage capacitor of a display element of a plurality of display elements of a display panel to receive a data signal via a leaky switch 402, providing the data signal to the storage capacitor when the leaky switch is in an on state at each of an on voltage to illuminate the display element and an off voltage 404, and holding the on voltage at an input of the leaky switch when the leaky switch is in an off state 406. In other embodiments, flow diagram may include any of the disclosure herein.

In utilizing the various embodiments of this disclosure, it would become apparent to one skilled in the art that combinations or variations of the above embodiments are possible for performing adaptive refresh. Although the present disclosure has been described in language specific to structural features and/or methodological acts, it is to be understood that the disclosure defined in the appended claims is not necessarily limited to the specific features or acts described. The specific features and acts disclosed are instead to be understood as particularly graceful implementations of the claimed disclosure useful for illustrating the present disclosure.

What is claimed is:

1. A display system comprising:

a display panel having a plurality of display elements;

a leaky switch coupled to a storage capacitor, the leaky switch to select the storage capacitor of a display element of the plurality of display elements to receive a data signal;

a data driver to provide the data signal to the storage capacitor when the leaky switch is in an on state at each of an on voltage for an emissive state of the display element and an off voltage for a non-emissive state of the display element and to hold the on voltage at an input of the leaky switch when the leaky switch is in an off state; and a drive transistor coupled to the storage capacitor, the drive transistor includes a gate electrode connected to a node that is connected to an output of the leaky switch and a terminal of the storage capacitor, wherein the off voltage is at least a magnitude of three times a threshold voltage to turn on the drive transistor to accommodate leakage of charge from the storage capacitor at the node, wherein the leaky switch has a conductive path during the on state and has a leakage path to discharge the storage capacitor at a discharge rate during the off state of the leaky switch to achieve a refresh rate of the display panel that is about 20 Hertz or less.

2. The display system of claim 1, wherein the data driver connects to the input of the leaky switch and the storage capacitor connects to an output of the leaky switch.

3. The display system of claim 1, wherein the data driver is to hold the on voltage at the input of the leaky switch when the leaky switch is in an off state and the storage capacitor is charged to the on voltage.

4. The display system of claim 1, further comprising a compensating circuit to charge the storage capacitor to a compensated on voltage, wherein the data driver is to hold the compensated on voltage at the input of the leaky switch when the leaky switch is in the off state.

5. The display system of claim 1, wherein the data driver is to provide different on voltages to respective storage capacitors of each display element of the plurality of display elements.

6. The display system of claim 1, wherein the data driver is to provide different off voltages to respective storage capacitors of each display element of the plurality of display elements.

7. The display system of claim 1, wherein the data driver is to provide different on voltages to respective storage capacitors of different colored display elements of the plurality of display elements to balance a white state.

8. A method comprising:

selecting a storage capacitor that is coupled to a drive transistor of a display element of a plurality of display elements of a display panel to receive a data signal via a leaky switch;

providing the data signal to the storage capacitor when the leaky switch is in an on state at each of an on voltage for an emissive state of the display element and an off voltage for an emissive state of the display element; and holding the on voltage at an input of the leaky switch when the leaky switch is in an off state, wherein the drive transistor includes a gate electrode connected to a node that is connected to an output of the leaky switch and a terminal of the storage capacitor, wherein the off voltage is at least a magnitude of three times a threshold voltage to turn on the drive transistor to accommodate leakage of charge from the storage capacitor at the node, wherein the leaky switch has a conductive path during the on state and has a leakage path to discharge the storage capacitor at a discharge rate during the off state of the leaky switch to achieve a refresh rate of the display panel that is about 20 Hertz or less.

9. The method of claim 8, further comprising selecting the off voltage to achieve a refresh rate less than about 20 Hertz.

10. The method of claim 8, further comprising:

providing a compensating circuit to charge the storage capacitor to a compensated on voltage; and wherein the holding comprises holding the compensated on voltage at the input of the leaky switch when the leaky switch is in the off state.

11. The method of claim 8, wherein the providing comprises providing different on voltages to respective storage capacitors of each display element of the plurality of display elements.

12. The method of claim 8, wherein the providing comprises providing different off voltages to respective storage capacitors of each display element of the plurality of display elements.

13. The method of claim 8, wherein the providing comprises providing different on voltages to respective storage capacitors of different colored display elements of the plurality of display elements to balance a white state.

14. An apparatus comprising:

a set of one or more processors; and a set of one or more non-transitory data storage devices that store instructions that, when executed by the set of one or more processors, cause the set of one or more processors to perform the following:

selecting a storage capacitor that is coupled to a drive transistor of a display element of a plurality of display elements of a display panel to receive a data signal via a leaky switch;

providing the data signal to the storage capacitor when the leaky switch is in an on state at each of an on voltage to illuminate the display element and an off voltage; and holding the on voltage at an input of the leaky switch when the leaky switch is in an off state, wherein the drive transistor includes a gate electrode connected to a node that is connected to an output of the leaky switch and a terminal of the storage capacitor, wherein the off voltage is at least a magnitude of three times a threshold voltage to turn on the drive transistor to accommodate leakage of charge from the storage capacitor at the node, wherein the leaky switch has a conductive path during the on state and has a leakage path to discharge the storage capacitor at a discharge rate during the off state of the leaky switch to achieve a refresh rate of the display panel that is about 20 Hertz or less.

15. The apparatus of claim 14, wherein the set of non-transitory data storage devices further stores instructions that, when executed by the set of one or more processors, cause the set of one or more processors to perform the following:

further comprising selecting the off voltage to achieve a refresh rate less than about 20 Hertz.

16. The apparatus of claim 14, wherein the set of non-transitory data storage devices further stores instructions that, when executed by the set of one or more processors, cause the set of one or more processors to perform the following:

further comprising:

providing a compensating circuit to charge the storage capacitor to a compensated on voltage; and wherein the holding comprises holding the compensated on voltage at the input of the leaky switch when the leaky switch is in the off state.

17. The apparatus of claim 14, wherein the set of non-transitory data storage devices further stores instructions that, when executed by the set of one or more processors, cause the set of one or more processors to perform the following:

wherein the providing comprises providing different on voltages to respective storage capacitors of each display element of the plurality of display elements.

18. The apparatus of claim 14, wherein the set of non-transitory data storage devices further stores instructions that, when executed by the set of one or more processors, cause the set of one or more processors to perform the following:

wherein the providing comprises providing different off voltages to respective storage capacitors of each display element of the plurality of display elements.

19. The apparatus of claim 14, wherein the set of non-transitory data storage devices further stores instructions that, when executed by the set of one or more processors, cause the set of one or more processors to perform the following:

wherein the providing comprises providing different on voltages to respective storage capacitors of different colored display elements of the plurality of display elements to balance a white state.

20. A circuit for a display element comprising:

a storage capacitor;

a leaky switch coupled to the storage capacitor, the leaky switch to select the storage capacitor of the display element to receive a data signal from a data driver when the leaky switch is in an on state at each of an on voltage for an emissive state of the display element and an off voltage for a non-emissive state of the display element and to hold the on voltage at an input of the leaky switch when the leaky switch is in an off state; and a drive transistor coupled to the storage capacitor, the drive transistor includes a gate electrode connected to a node that is connected to an output of the leaky switch and a terminal of the storage capacitor, wherein the off voltage is at least a magnitude of three times a threshold voltage to turn on the drive transistor to accommodate leakage of charge from the storage capacitor at the node, wherein the leaky switch has a conductive path during the on state and has a leakage path to discharge the storage capacitor at a discharge rate during the off state of the leaky switch to achieve a refresh rate that is about 20 Hertz or less.

21. The circuit of claim 20, wherein the drive transistor includes a source or drain electrode connected to another terminal of the storage capacitor.

* * * * *